US009657654B2

(12) United States Patent
Kayane et al.

(10) Patent No.: US 9,657,654 B2
(45) Date of Patent: May 23, 2017

(54) ENGINE SPEED CONTROLLER OF WORK MACHINE

(71) Applicant: Hitachi Construction Machinery Co., Ltd., Tokyo (JP)

(72) Inventors: Masahiro Kayane, Ibaraki (JP); Katsuaki Kodaka, Ibaraki (JP); Yuuta Nakamura, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 35 days.

(21) Appl. No.: 14/779,341

(22) PCT Filed: Mar. 13, 2014

(86) PCT No.: PCT/JP2014/056751
§ 371 (c)(1),
(2) Date: Sep. 23, 2015

(87) PCT Pub. No.: WO2014/156697
PCT Pub. Date: Oct. 2, 2014

(65) Prior Publication Data

US 2016/0069282 A1 Mar. 10, 2016

(30) Foreign Application Priority Data

Mar. 25, 2013 (JP) ..... 2013-062152

(51) Int. Cl.
*F15B 11/04* (2006.01)
*F02D 29/04* (2006.01)
(Continued)

(52) U.S. Cl.
CPC ..... *F02D 29/04* (2013.01); *E02F 9/2246* (2013.01); *E02F 9/2282* (2013.01);
(Continued)

(58) Field of Classification Search
CPC .... F15B 2211/20523; F15B 2211/6316; F15B 2211/6651; F15B 2211/85; F02D 29/04
(Continued)

(56) References Cited

U.S. PATENT DOCUMENTS 4,779,591 A * 10/1988 Tordenmalm ..... F02D 41/083 123/352
4,942,737 A * 7/1990 Tatsumi ..... E02F 9/2246 60/431
(Continued)

FOREIGN PATENT DOCUMENTS

GB 2467056 A 7/2010
JP 03115748 A 5/1991
(Continued)

OTHER PUBLICATIONS

Extended European Search Report issued in counterpart European Application No. 14775831.2 dated Oct. 28, 2016 (nine (9) pages).

*Primary Examiner* — Thomas E Lazo
(74) *Attorney, Agent, or Firm* — Crowell & Moring LLP

(57) ABSTRACT

The present invention is to reduce the flow rate of pressure oil discharged from a main pump and returned to a tank when specific work is executed with an operation amount of an operating device being made small in the state in which an engine is kept at an idling speed. According to the present invention, there is provided a main controller (20) which is capable of controlling the speed of an engine (11) to a normal work speed at which a work implement such as a boom (4) can perform normal work and which controls the speed of the engine (11) to an idling speed serving as a speed lower than the normal work speed when an operating device has returned from an operating position to a neutral position. Configuration is made such that the main controller (20) performs a control process for bringing the speed of the engine (11) to a specific work speed serving as a speed
(Continued)

higher than the idling speed but lower than the normal work speed, on detecting execution of the specific work which is performed with an operation amount of the operating device such as a boom operating device (16) being kept small in a state in which the speed of the engine (11) is kept at the idling speed.

6 Claims, 6 Drawing Sheets

(51) Int. Cl.

| | |
|---|---|
| ***F02D 31/00*** | (2006.01) |
| ***E02F 9/22*** | (2006.01) |
| ***F15B 21/08*** | (2006.01) |
| ***F15B 13/04*** | (2006.01) |
| *F02D 41/02* | (2006.01) |

(52) U.S. Cl.
CPC ..... *E02F 9/2285* (2013.01); *E02F 9/2296* (2013.01); *F02D 31/001* (2013.01); *F15B 11/04* (2013.01); *F15B 13/0401* (2013.01); *F15B 21/082* (2013.01); *F02D 41/021* (2013.01); *F15B 2211/20523* (2013.01); *F15B 2211/20546* (2013.01); *F15B 2211/30* (2013.01); *F15B 2211/45* (2013.01); *F15B 2211/633* (2013.01); *F15B 2211/6309* (2013.01); *F15B 2211/6316* (2013.01); *F15B 2211/6651* (2013.01); *F15B 2211/85* (2013.01)

(58) Field of Classification Search
USPC ..... 60/431; 701/50
See application file for complete search history.

(56) References Cited

U.S. PATENT DOCUMENTS

| | | | | | |
|---|---|---|---|---|---|
| 5,586,536 | A * | 12/1996 | Seo | E02F 9/2246 | 123/352 |
| 7,533,527 | B2 * | 5/2009 | Naruse | E02F 9/2235 | 60/433 |
| 7,664,586 | B2 * | 2/2010 | Ozawa | E02F 9/2235 | 180/14.1 |
| 2010/0235060 | A1 * | 9/2010 | Yamada | E02F 9/2246 | 701/50 |
| 2012/0279203 | A1 * | 11/2012 | Arai | B01D 53/944 | 60/276 |

FOREIGN PATENT DOCUMENTS

| | | | |
|---|---|---|---|
| JP | 04041942 | A | 2/1992 |
| JP | 2000303872 | A | 10/2000 |
| JP | 2001-173605 | A | 6/2001 |
| JP | 3316057 | B2 | 8/2002 |
| JP | 2011007064 | A | 1/2011 |
| WO | WO 86/02975 | A1 | 5/1986 |

* cited by examiner

ENGINE SPEED CONTROLLER OF WORK MACHINE

TECHNICAL FIELD

The present invention relates to an engine speed controller of a working machine such as a hydraulic excavator which is provided with an engine, a main pump, and a main controller controlling the speed of the engine to an idling speed serving as a speed lower than a normal work speed.

BACKGROUND ART

A working machine such as a hydraulic excavator is provided with an engine, a main pump, and hydraulic cylinders. The main pump is driven by the engine. The hydraulic cylinders such as a boom cylinder, an arm cylinder, etc. operate due to pressure oil discharged from the maim pump so as to drive work implements such as a boom, an arm, etc. constituting a front working device. Moreover, the hydraulic excavator is provided with directional control valves and operating devices. The directional control valves such as a boom directional control valve, an arm directional control valve etc. control the flow of the pressure oil supplied from the main pump to the hydraulic cylinders. The operating devices such as a boom operating device, an arm operating device, etc. perform switching operation on these directional control valves.

In addition, among hydraulic excavators configured thus, there is a hydraulic excavator provided with a main controller which is capable of controlling the speed of an engine to a normal work speed at which a work implement can perform normal work and which controls the speed of the engine to an idling speed serving as a speed lower than the normal work speed when an operating device has been returned to a neutral position from an operating position. This kind of background-art technique has been disclosed in Patent Literature 1.

CITATION LIST

Patent Literature

Patent Literature 1: JP-A-3-115748

SUMMARY OF INVENTION

Technical Problem

The working machine such as the hydraulic excavator is provided with the main controller which controls the speed of the engine to the idling speed lower than the normal work speed when the operating device has been returned to the neutral position as described above. In some cases, in the state in which the speed of the engine is kept at the idling speed in the working machine, the operating device may be operated to perform specific work such as light load work while the operation amount of the operating device is kept small. Even during the specific work, in the background-art technique, the main controller makes control to increase the speed of the engine from the idling speed up to the normal work speed at which the normal work can be performed with the operation amount of the operating device being made large. The flow rate of pressure oil discharged from the main pump also increases in proportion to such an increase of the engine speed. Accordingly, most of the flow rate of pressure oil discharged from the main pump is returned to a tank through a directional control valve whose switching amount is kept small. That is, in the background-art technique, the pressure oil is discharged at a higher flow rate than necessary from the main pump during the aforementioned specific work which is performed with the operation amount of the operating device being made small in the state in which the engine is kept at the idling speed. Thus, an energy loss is generated.

The present invention has been accomplished under the aforementioned actual circumstances in the background-art technique. An object of the present invention is to provide an engine speed controller of a working machine which can reduce the flow rate of pressure oil discharged from a main pump and returned to a tank during execution of specific work which is performed with an operation amount of an operating device being made small in the state in which an engine is kept at an idling speed.

Solution to Problem

In order to achieve the object, the present invention provides an engine speed controller of a working machine, the engine speed controller being provided in the working machine, the working machine having an engine, a main pump driven by the engine, a hydraulic cylinder operating due to pressure oil discharged from the main pump to thereby drive a work implement, a directional control valve controlling the flow of the pressure oil supplied from the main pump to the hydraulic cylinder, and an operating device performing switching operation on the directional control valve, the engine speed controller including: a main controller which is capable of controlling the speed of the engine to a normal work speed at which the work implement can perform normal work and which controls the speed of the engine to an idling speed serving as a speed lower than the normal work speed when the operating device has been returned from an operating position to a neutral position, wherein: the main controller performs a control process for bringing the speed of the engine to a specific work speed serving as a speed which is higher than the idling speed but lower than the normal work speed, on detecting execution of the specific work which is performed with an operation amount of the operating device being kept small in the state in which the speed of the engine is kept at the idling speed.

According to the present invention having the aforementioned configuration, the main controller controls the speed of the engine to the specific work speed on detecting execution of the specific work which is performed with the operation amount of the operating device being made small in the state in which the speed of the engine is kept at the idling speed, the specific work speed serving as a speed lower than the normal work speed at which the normal work can be performed with the operation amount of the operating device being made large. Thus, the flow rate of pressure oil discharged from the main pump during the specific work can be made smaller than the flow rate of pressure oil discharged from the main pump during the normal work so that the flow rate of pressure oil discharged from the main pump and returned to a tank can be reduced when the specific work is performed.

Moreover, according to the present invention, the aforementioned configuration may be used so that: the main controller detects the execution of the specific work based on at least one of the operation amount of the operating device, an operation speed of the operating device, and pump discharge pressure serving as discharge pressure of the main pump.

Moreover, according to the present invention, the aforementioned configuration may be used so that: the main controller performs a control process for bringing the engine speed to the normal work speed on detecting execution of the normal work when the control process for bringing the engine speed to the specific work speed is being performed due to the detection of the execution of the specific work.

Moreover, according to the present invention, the aforementioned configuration may be used so that: the main controller performs a control process to increase the engine speed gradually from the specific work speedup to the normal work speed.

Advantageous Effects of Invention

According to the present invention, the main controller can keep the speed of the engine at the specific work speed serving as a speed higher than the idling speed but lower than the normal work speed during execution of the specific work which is performed with the operation amount of the operating device being made small in the state in which the engine is kept at the idling speed. Thus, according to the present invention, the flow rate of pressure oil discharged from the main pump can be smaller than that during the normal work so that the flow rate of pressure oil discharged from the main pump and returned to a tank can be reduced with a result that an energy loss can be reduced in comparison with the background-art technique.

DESCRIPTION OF EMBODIMENTS

Embodiments of an engine speed controller of a working machine according to the present invention will be described below in accordance with the drawings.

Figure 1:
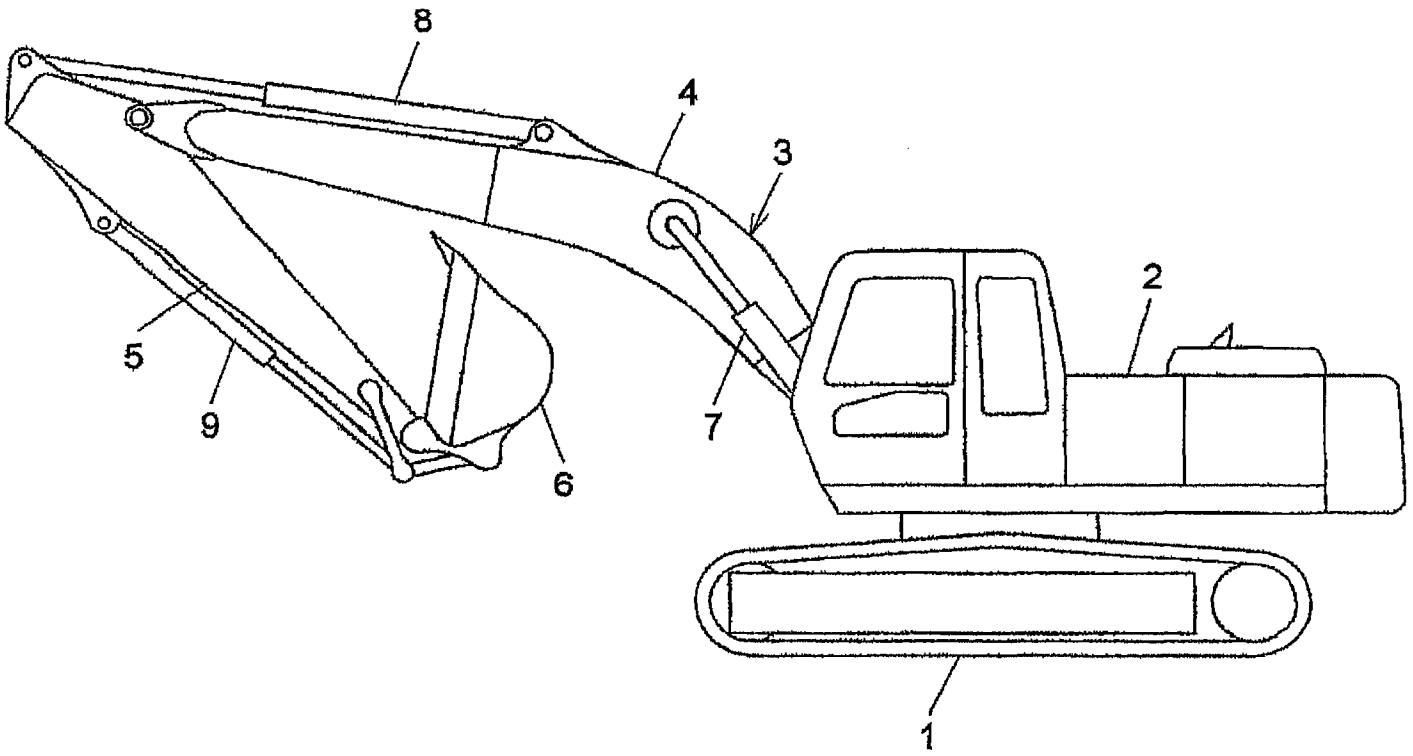
FIG. 1 A side view showing a hydraulic excavator taken as an example of a working machine.

FIG. 1 is a side view showing a hydraulic excavator taken as an example of the working machine.

As shown in FIG. 1, the hydraulic excavator is provided with a travelling body 1, a swinging body 2 which is disposed on the travelling body 1, and a front working device 3 which is attached to the swinging body 2 so as to be rotatable in an up/down direction. The front working device 3 is provided with a boom 4 which is attached to the swinging body 2, an arm 5 which is attached to a distal end of the boom 4, and a bucket 6 which is attached to a distal end of the arm 5. Each of the boom 4, the arm 5 and the bucket 6 constitutes a work implement. In addition, the front working device 3 is also provided with hydraulic cylinders such as a boom cylinder 7 which drives the boom 4, an arm cylinder 8 which drives the arm 5, and a bucket cylinder 9 which drives the bucket 6.

Figure 2:
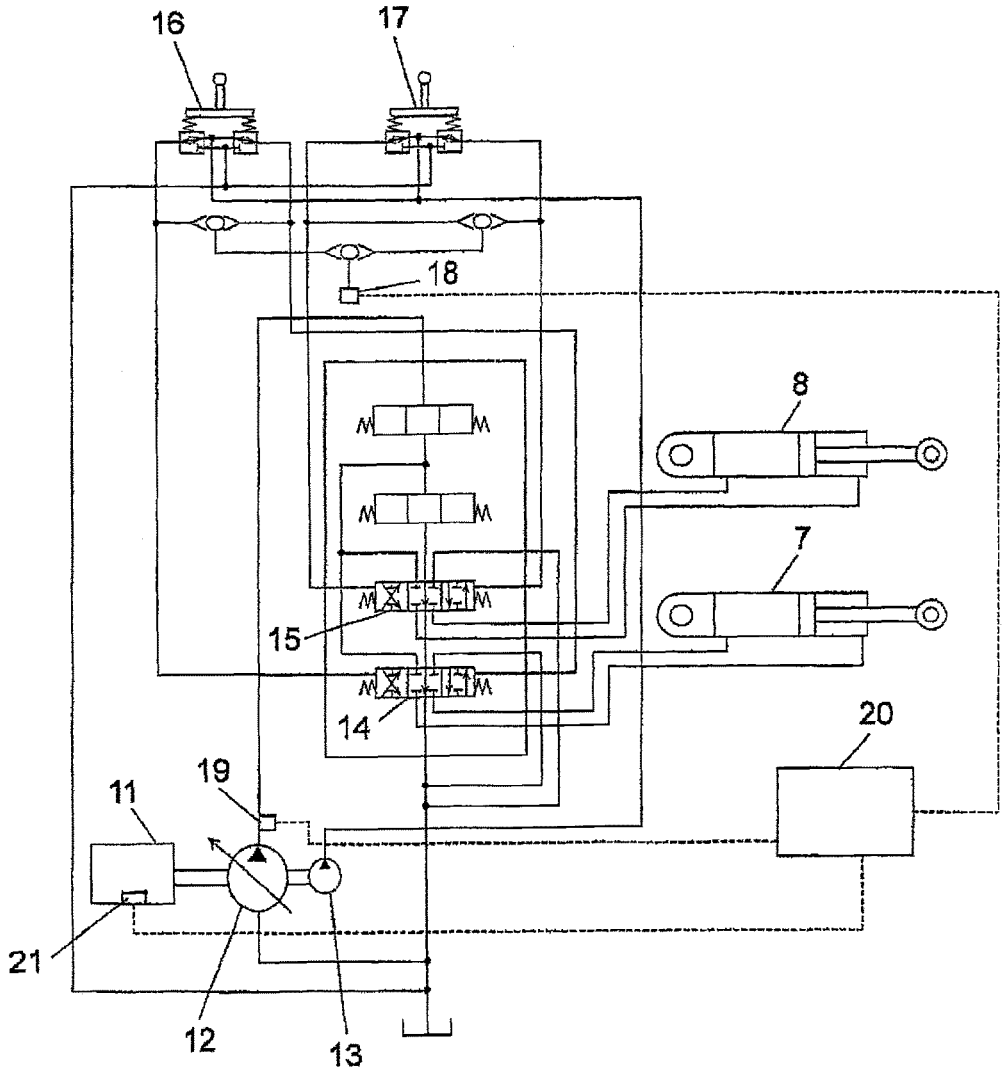
FIG. 2 An electric and hydraulic circuit diagram showing an engine speed controller according to an embodiment of the present invention provided in the hydraulic excavator shown in FIG. 1.

FIG. 2 is an electric and hydraulic circuit diagram showing an engine speed controller according to an embodiment of the present invention provided in the hydraulic excavator shown in FIG. 1.

The electric and hydraulic circuit shown in FIG. 2 shows a main part of the engine speed controller according to the embodiment of the present invention, from which the bucket cylinder 9 etc. has been removed.

As shown in FIG. 2, the engine speed controller according to the embodiment is provided with an engine 11, a main pump 12 which is driven by the engine 11, and a pilot pump 13. In addition, in the embodiment, there are provided the boom cylinder 7 which drives the aforementioned boom 4, the arm cylinder 8 which drives the arm 5, directional control valves such as a boom directional control valve 14 and an arm directional control valve 15 which control the flow of pressure oil supplied from the main pump 12 to the boom cylinder 7 and the arm cylinder 8 respectively, and operating devices such as a boom operating device 16 and an arm operating device 17 which perform switching operation on the boom directional control valve 14 and the arm directional control valve 15 respectively.

Further, in the embodiment, there is provided a main controller 20 which is capable of controlling the speed of the engine 11 to a normal work speed at which a work implement such as the boom 4 or the arm 5 can perform normal work, and which controls the speed of the engine 11 to an idling speed serving as a speed lower than the normal work speed when an operating device such as the boom operating device 16 etc. has been returned from an operating position to a neutral position. Moreover, particularly, the main controller 20 provided in the embodiment performs a control process for bringing the speed of the engine 11 to a specific work speed serving as a speed which is higher than the idling speed but lower than the normal work speed, on detecting execution of specific work such as light load work which is performed with an operation amount of the operating device being kept small in the state in which the speed of the engine 11 is kept at the idling speed.

Figure 3:
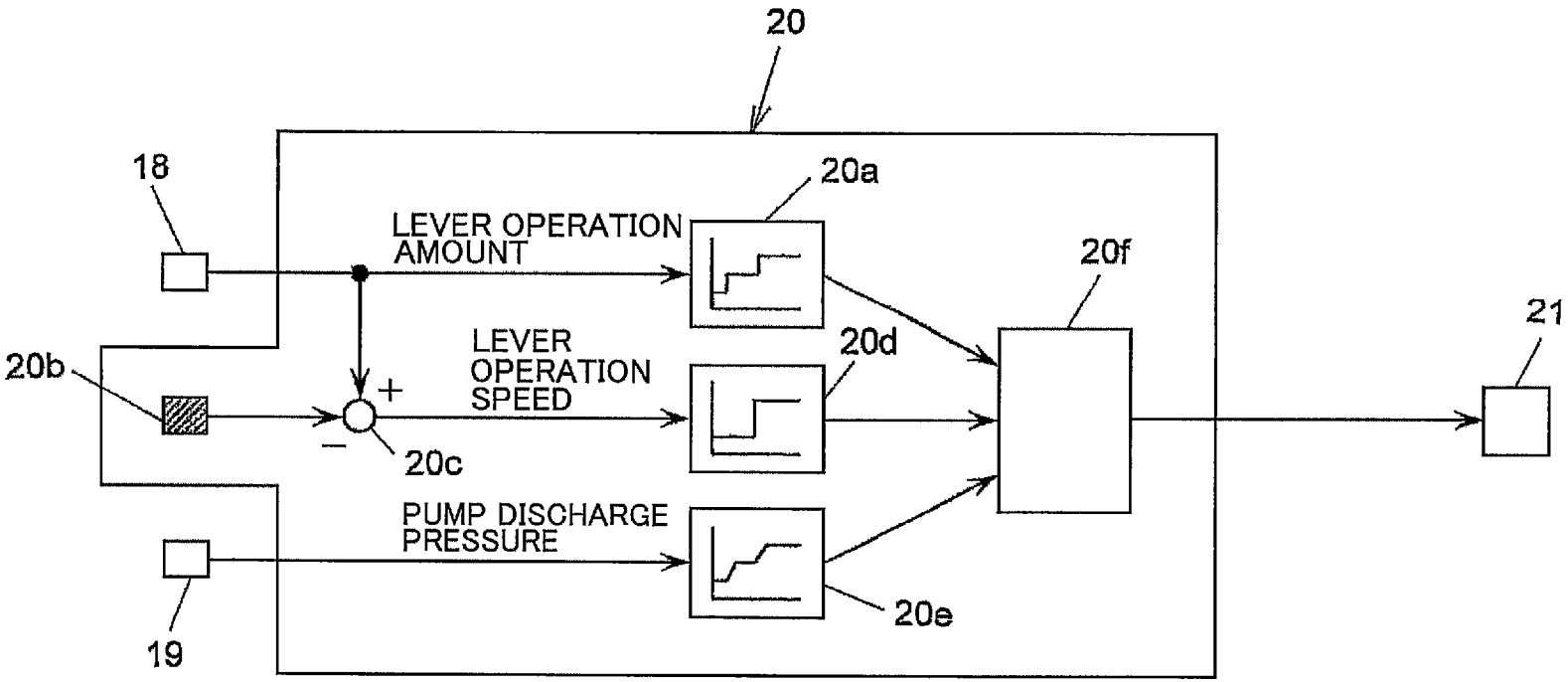
FIG. 3 A view showing the configuration of a main part of amain controller provided in the engine speed controller according to the embodiment of the present invention shown in FIG. 2.
Figure 4:
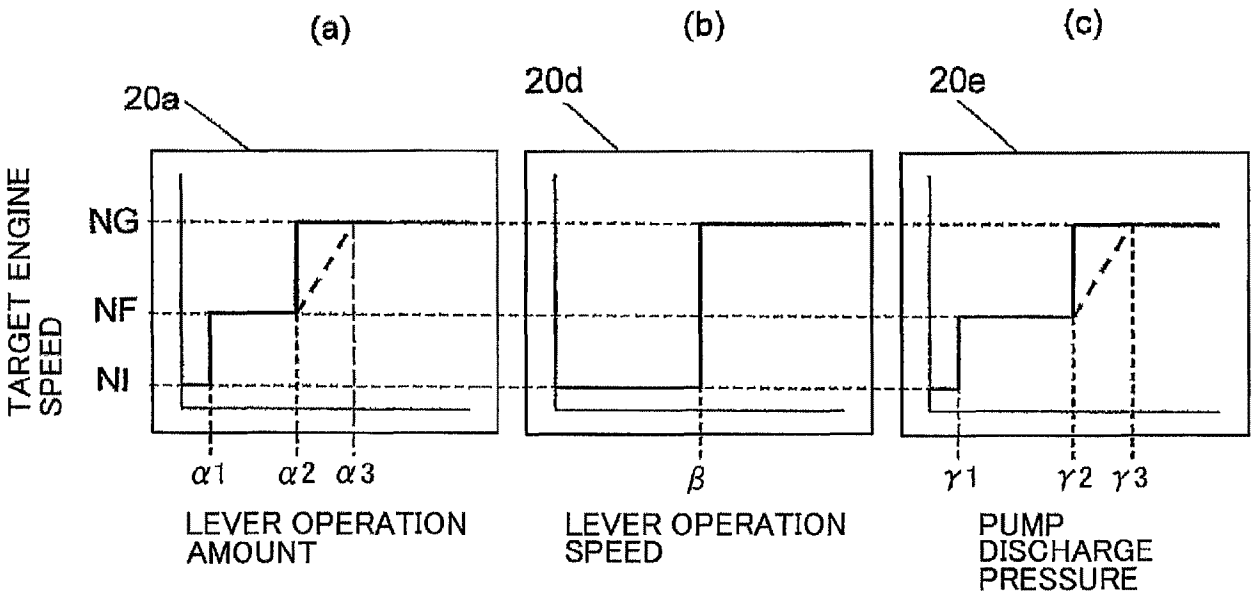
FIG. 4 A view showing the configurations of three function setting portions included in the main controller shown in FIG. 3.

FIG. 3 is a view showing the configuration of a main part of the main controller provided in the engine speed controller according to the embodiment of the present invention shown in FIG. 2. FIG. 4 is a view showing the configurations of three function setting portions included in the main controller shown in FIG. 3.

The main controller 20 detects the execution of the aforementioned specific work based on at least one of the operation amount of the operating device, an operation speed of the operating device, and pump discharge pressure serving as discharge pressure of the main pump 12. For example, in the embodiment, configuration is made such that the execution of the specific work is detected based on all the three detection factors, i.e. the operation amount of the operating device, the operation speed of the operating device, and the pump discharge pressure.

As shown in FIGS. 2 and 3, in the embodiment, there are provided a pressure sensor 18 which detects the operation amount of the operating device such as the boom operating device 16 or the arm operating device 17, a calculation portion 20*c* which is included in the main controller 20 and which calculates the operation speed of the operating device based on a signal outputted from the pressure sensor 18, and a discharge pressure sensor 19 which detects the pump discharge pressure.

In addition, as shown in FIGS. 3 and 4, in the embodiment, there are provided a first function setting portion 20*a*, a second function setting portion 20*d* and a third function setting portion 20*e* which are included in the main controller 20. The relation between the operation amount detected by the pressure sensor 18, i.e. a lever operation amount, and a target engine speed are set in the first function setting portion 20*a*. The relation between the operation speed calculated by the calculation portion 20*c* and the target engine speed is set in the second function setting portion 20*d*. The relation between the pump discharge pressure detected by the discharge pressure sensor 19 and the target engine speed is set in the third function setting portion 20*e*.

In the aforementioned calculation portion 20*c*, the operation speed of the operating device, i.e. a lever operation speed, is calculated based on a signal which is outputted from the pressure sensor 18 this time and a signal which was outputted from the pressure sensor 18 last time and is stored in a memory 20*b* of the main controller 20.

As shown in the diagram (a) of FIG. 4, the first function setting portion 20*a* includes a first operation amount threshold $\alpha$1 which corresponds to an operation amount regarded as the operating device has been operated, and a second operation amount threshold $\alpha$2 which is a value larger than the first operation amount threshold $\alpha$1 and which corresponds to an operation amount of the operating device regarded as having changed from an operation amount for the specific work to an operation amount for the normal work. A target engine speed NF corresponding to a specific work speed is set as a value which is higher than a target engine speed NI corresponding to the idling speed but lower than a target engine speed NG corresponding to the normal work speed.

Incidentally, the first function setting portion 20*a* may be configured to include a third operation amount threshold $\alpha$3 which is a value larger than the second operation amount threshold $\alpha$2 and to have a setting relation in which the target engine speed is increased gradually as the operation amount of the operating device increases from the second operation amount threshold $\alpha$2 toward the third operation amount threshold $\alpha$3, as designated by the broken line in the diagram (a) of FIG. 4.

In addition, as shown in the diagram (b) of FIG. 4, the second function setting portion 20*d* includes an operation speed threshold $\beta$ corresponding to an operation speed of the operating device regarded as having changed from an operation speed for the specific work to an operation speed for the normal work.

In addition, as shown in the diagram (c) of FIG. 4, the third function setting portion 20*e* includes a first discharge pressure threshold $\gamma$1 which corresponds to pump discharge pressure regarded as the operating device has been operated from the neutral position, and a second discharge pressure threshold $\gamma$2 which is a value larger than the first discharge pressure threshold $\gamma$1 and which corresponds to pump discharge pressure regarded as having changed from discharge pressure for the specific work to discharge pressure for the normal work.

Incidentally, the third threshold setting portion 20*e* may be configured to include a third discharge pressure threshold $\gamma$3 which is a value larger than the second discharge pressure threshold $\gamma$2 and to have a setting relation in which the target engine speed is increased gradually as the pump discharge pressure increases from the second discharge pressure threshold $\gamma$2 toward the third discharge pressure threshold $\gamma$3, as designated by the broken line in the diagram (c) of FIG. 4.

In addition, in the embodiment, there are provided a largest value selection portion 20*f* and an engine controller 21. The largest value selection portion 20*f* is included in the main controller 20 to select a largest value from the target engine speed outputted from the first function setting portion 20*a*, the target engine speed outputted from the second function setting portion 20*d*, and the target engine speed outputted from the third function setting portion 20*e*. The engine controller 21 controls the speed of the engine 11 in accordance with the largest value of the target engine speed outputted from the largest value selection portion 20*f*.

In the embodiment configured thus, when the operating device such as the boom operating device 16 is kept at the neutral position, the lever operation amount of the boom operating device 16 is smaller than the first operation amount threshold $\alpha$1 of the first function setting portion 20*a*, the lever operation speed of the boom operating device 16 is also smaller than the operation speed threshold $\beta$ of the second function setting portion 20*d* and the pump discharge pressure of the main pump 12 is also smaller than the first threshold $\gamma$1 of the third function setting value 20*e*, with a result that the target engine speed NI corresponding to the idling speed is outputted to the engine controller 21 from the largest value selection portion 20*f*. Consequently, the engine 11 is driven at the idling speed and kept at a work stop state.

In addition, when, for example, the boom operating device 16 has been operated by a large amount from the neutral position in order to perform the normal work such as soil excavation work, the lever operation amount of the boom operating device 16 becomes larger than the second operation amount threshold $\alpha$2 of the first function setting portion 20*a*, the lever operation speed of the boom operating device 16 also becomes larger than the operation speed threshold $\beta$ of the second function setting portion 20*d*, and the pump discharge pressure of the main pump 12 also becomes larger than the second discharge pressure threshold $\gamma$2 of the third function setting portion 20*e*, with a result that the target engine speed NG corresponding to the normal work speed is outputted to the engine controller 21 from the largest value selection portion 20*f*. Consequently, the engine 11 is driven at the normal work speed, and the main pump 12 is driven by a large driving power to supply discharged pressure oil at a large flow rate to the boom cylinder 7 through the boom directional control valve 14. Thus, desired normal work can be performed.

In addition, when, for example, the boom operating device 16 has been operated by a smaller amount than that for the normal work in order to perform light load work such as soil leveling work, i.e. the specific work, the lever operation amount of the boom operating device 16 is kept between the first operation amount threshold $\alpha$1 and the second operation amount threshold $\alpha$2 of the first function setting portion 20*a*, the lever operation speed of the boom operating device 16 is kept to be smaller than the operation speed threshold $\beta$ of the second function setting portion 20*d*, and the pump discharge pressure of the main pump 12 is kept between the first discharge pressure threshold $\gamma$1 and the second discharge pressure threshold $\gamma$2 of the third function setting portion 20*e*, with a result that the target engine speed NF corresponding to the specific work speed is outputted to the engine controller 21 from the largest value selection portion 20*f*. Consequently, the engine 11 is driven at the specific work speed serving as a speed smaller than the normal work speed, and the main pump 12 is driven by a smaller driving power than that for the normal work to supply discharged pressure oil at a smaller flow rate to the boom cylinder 7 through the boom directional control valve 14. Thus, desired specific work can be performed.

According to the embodiment configured thus, during execution of the specific work which is performed with the operation amount of the operating device being made small in the state in which the engine 11 is kept at the idling speed, the main controller 20 keeps the speed of the engine 11 at the specific work speed serving as a speed higher than the idling speed but lower than the normal work speed, as described above. Thus, in the embodiment, the flow rate of pressure oil discharged from the main pump 12 becomes smaller than that for the normal work so that the flow rate of pressure oil discharged from the main pump 12 and returned to a tank through the directional control valve such as the boom directional control valve 16 can be reduced. Therefore, an energy loss can be reduced.

Incidentally, the third operation amount threshold $\alpha$3 is set in the first function setting portion 20*a* of the main controller 20 so that the target engine speed can be increased gradually as the lever operation amount increases from the second operation amount threshold $\alpha$2 to the third operation amount threshold $\alpha$3, as designated by the broken line in the diagram (a) of FIG. 4. In addition, the third discharge pressure threshold 73 is set in the third function setting portion 20*e* so that the target engine speed can be increased gradually as the pump discharge pressure increases from the second discharge pressure threshold $\gamma$2 to the third discharge pressure threshold $\gamma$3, as designated by the broken line in the diagram (c) of FIG. 4. The configuration made thus can suppress a sudden change in the target engine speed when work is shifted from the specific work which is performed with the operation amount of the operating device being kept small, to the normal work which is performed with the operation amount of the operating device being made large. Consequently, it is possible to suppress the sudden increase of the speed of the engine 11, so that it is possible to shift the work smoothly from the specific work to the normal work while securing stable operability of the hydraulic cylinder such as the boom cylinder 7 etc. driving the work implement such as the boom 4 etc. Thus, it is possible to secure excellent workability.

Figure 5:
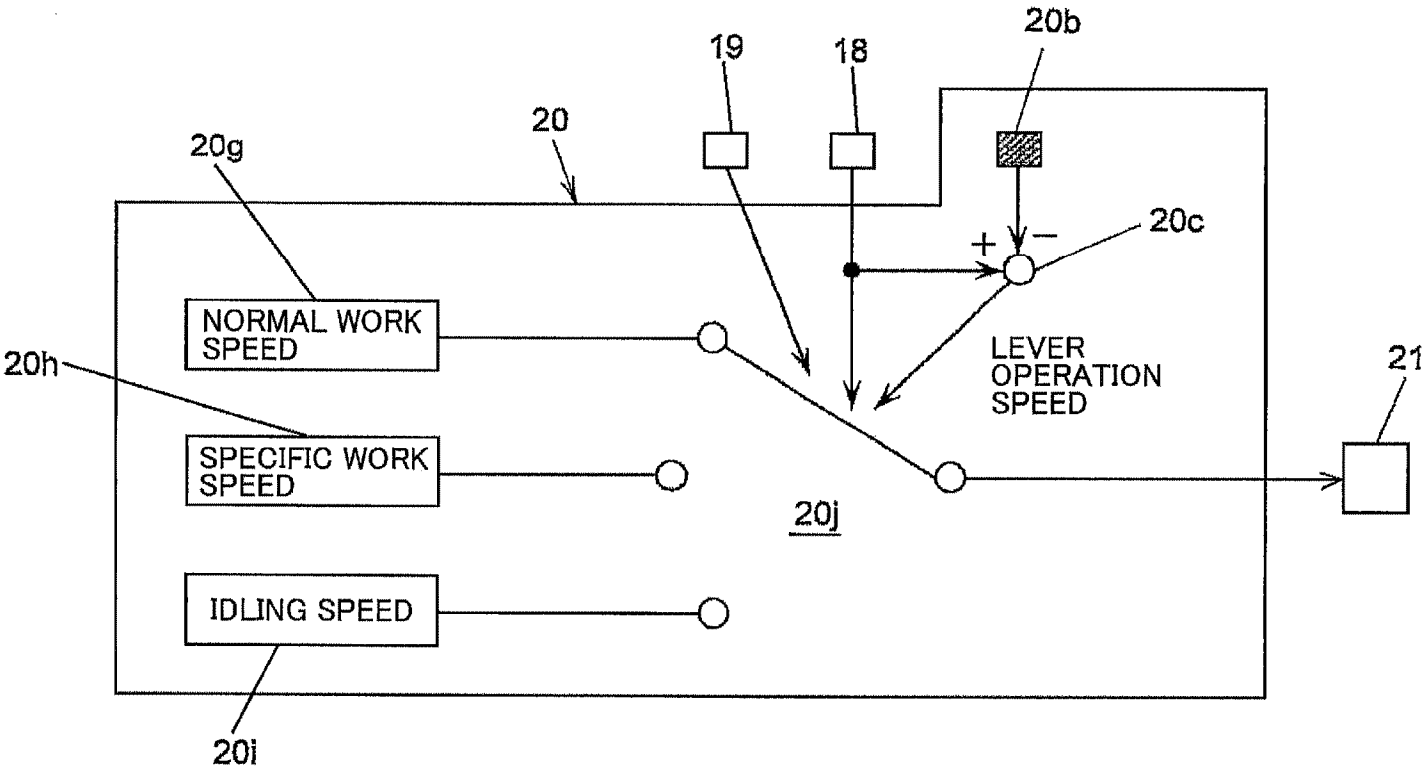
FIG. 5 A view showing the configuration of a main part of amain controller provided in another embodiment of the present invention.

FIG. 5 is a view showing the configuration of a main part of a main controller provided in another embodiment of the present invention.

Also in the other embodiment of the present invention shown in FIG. 5, there are provided a pressure sensor 18 which detects an operation amount of an equivalent operating device to that in the aforementioned embodiment, a calculation portion 20*c* which is included in the main controller 20 and which calculates an operation speed of the operating device based on a signal outputted from the pressure sensor 18, and a pressure sensor 19 which detects pump discharge pressure. In the other embodiment, there are particularly provided a first setting portion 20*g*, a second setting portion 20*h*, and a third setting portion 20*i* which are included in the main controller 20. A target engine speed corresponding to a normal work speed is set in the first setting portion 20*g*. A specific work speed serving as a speed lower than the normal work speed is set in the second setting portion 20*h*. An idling speed further lower than the specific work speed is set in the third setting portion 20*i*. In addition, in the other embodiment, there are provided a switching portion 20*j* and an engine controller 21. The switching portion 20*j* selects one from the target engine speed set in the first setting portion 20*g*, the target engine speed set in the second setting portion 20*h* and the target engine speed set in the third setting portion in accordance with the operation amount of the operating device detected by the pressure sensor 18, the operation speed of the operating device calculated by the calculation portion 20*c* and the pump discharge pressure detected by the discharge pressure sensor 19, and outputs the selected target engine speed. The engine controller 21 controls the speed of the engine 11 in accordance with the target engine speed outputted from the switching portion 20*j*. The remaining configuration is equivalent to the aforementioned configuration shown in FIGS. 1 and 2.

Figure 6:
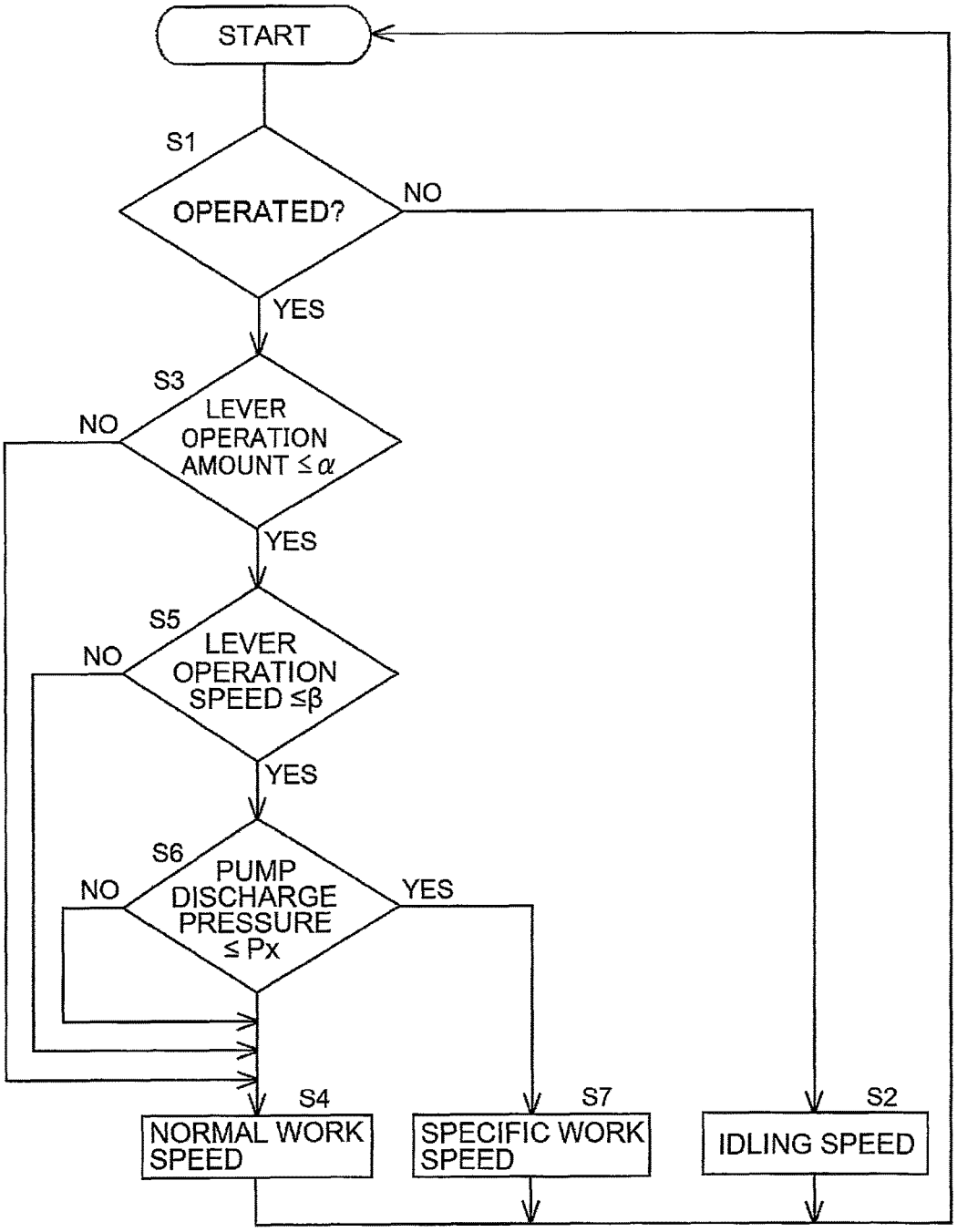
FIG. 6 A flow chart showing a processing procedure in the main controller shown in FIG. 5.

FIG. 6 is a flow chart showing a processing procedure in the main controller shown in FIG. 5.

As shown in FIG. 6, in the other embodiment, determination is first made in the main controller 20 as to whether an operating device has been operated or not (step S1). This determination is made based on a signal outputted from the pressure sensor 18. When the determination is No, i.e. when the determination is made that the operating device has not been operated, the switching portion 20*j* performs a process for outputting an idling speed set in the third setting portion 20*i* to the engine controller 21 (step S2). Consequently, the engine 11 is driven at the idling speed and kept at a work stop state.

When the determination in the step S1 is Yes, i.e. when the operating device is regarded as having been operated from a neutral position, determination is made as to whether the operation amount of the operating device is at most equal to a predetermined threshold $\alpha$ or not (step S3). This threshold $\alpha$ corresponds to an operation amount regarded as having changed from an operation amount for specific work such as light load work to an operation amount for normal work such as excavation work. Accordingly, when the determination in the step S3 is No, i.e. when the determination is made that the operating device has been operated largely with the intention of doing the normal work, the switching portion 20*j* performs a process for outputting a normal work speed set in the first setting portion 20*g* to the engine controller 21 (step S4). Consequently, the engine 11 is driven at the normal work speed to thereby increase the flow rate of pressure oil discharged from the main pump 12. Thus, the normal work such as excavation work is performed.

When the determination in the step S3 is Yes, i.e. when the determination is made that the lever operation amount of the operating device is at most equal to the predetermined threshold $\alpha$, determination is made as to whether the operation speed of the operating device is at most equal to a predetermined threshold $\beta$ or not (step S5). This threshold $\beta$ corresponds to an operation speed regarded as having changed from an operation speed for the specific work to an operation speed for the normal work. Accordingly, when the determination in the step S5 is No, i.e. when the determination is made that the operation speed of the operating device is larger than the threshold $\beta$, the switching portion 20*j* performs a process for outputting the normal work speed set in the first setting portion 20*g* to the engine controller 21 (step S4). Consequently, the engine 11 is driven at the normal work speed as described above.

When the determination in the step S5 is Yes, i.e. when the operation speed of the operating device is at most equal to the threshold $\beta$, determination is made as to whether the pump discharge pressure of the main pump 12 is at most equal to a threshold Px or not (step S6). This threshold Px corresponds to pump discharge pressure regarded as having changed from pump discharge pressure for the specific work to pump discharge pressure for the normal work. Accordingly, when the determination in the step S6 is No, i.e. when the determination is made that the pump discharge pressure of the operating device is larger than the threshold Px, the switching portion 20*j* performs a process for outputting the normal work speed set in the first setting portion 20*g* to the engine controller 21 (step S4). Consequently, the engine 11 is driven at the normal work speed as described above.

When the determination in the step S6 is Yes, i.e. when the determination is made that the pump discharge pressure of the operating device is at most equal to the threshold Px, the specific work is regarded as being requested to be executed and the switching portion 20*j* performs a process for outputting the specific work speed set in the second setting portion 20*h* to the engine controller 21 (step S7). Consequently, the engine 11 is driven at the specific work speed so that the flow rate of pressure oil discharged from the main pump 12 can be suppressed to be smaller than that for the normal work. Thus, light load work such as leveling work, i.e. the specific work is performed. The other embodiment configured thus can obtain an equivalent effect to that of the aforementioned embodiment.

Incidentally, in the aforementioned other embodiment, configuration may be made so that a low pass filter can be provided between the switching portion 20*j* of the main controller 20 and the engine controller 21.

When the working machine configured thus shifts its work from specific work which is performed with the operation amount of the operating device being kept small, to normal work which is performed with the operation amount of the operating device being made large, a target engine speed outputted from the switching portion 20*j* can be outputted to the engine controller 21 with a time lag provided by the low pass filter. Consequently, it is possible to suppress the sudden increase of the speed of the engine 11, so that it is possible to shift the work smoothly from the specific work to the normal work while securing stable operability of a hydraulic cylinder such as the boom cylinder 7 driving a work implement such as the boom 4. Thus, it is possible to secure excellent workability.

Incidentally, although execution of the specific work is detected based on three detection factors, i.e. the operation amount of the operating device, the operation speed of the operating device and the pump discharge pressure in each of the embodiment shown in FIGS. 1 to 4 and the other embodiment shown in FIGS. 5 and 6, the present invention is not limited to detection of the execution of the specific work in the aforementioned manner. That is, the execution of the specific work may be detected based on one or two of the operation amount of the operating device, the operation speed of the operating device and the pump discharge pressure.

REFERENCE SIGNS LIST

3 front working device
4 boom (work implement)
5 arm (work implement)
6 bucket (work implement)
7 boom cylinder (hydraulic cylinder)
8 arm cylinder (hydraulic cylinder)
11 engine
12 main pump
13 pilot pump
14 boom directional control valve
15 arm directional control valve
16 boom operating device
17 arm operating device
18 pressure sensor
19 discharge pressure sensor
20 main controller
20*a* first function setting portion
20*b* memory
20*c* calculation portion
20*d* second function portion
20*e* third function portion
20*f* largest value selection portion
20*g* first setting portion
20*h* second setting portion
20*i* third setting portion
20*j* switching portion
21 engine controller
α1 first operation amount threshold
α2 second operation amount threshold
α3 third operation amount threshold
β operation speed threshold
γ1 first discharge pressure threshold
γ2 second discharge pressure threshold
γ3 third discharge pressure threshold

The invention claimed is:

1. An engine speed controller of a working machine, the engine speed controller being provided in the working machine, the working machine having an engine (11), a main pump (12) driven by the engine (11), a hydraulic cylinder (7, 8) operating due to pressure oil discharged from the main pump (12) to thereby drive a work implement (4, 5), a directional control valve (14, 15) controlling the flow of the pressure oil supplied from the main pump (12) to the hydraulic cylinder (7, 8), and an operating device (16, 17) performing switching operation on the directional control valve (14, 15), the engine speed controller comprising: a main controller (20) which is capable of controlling the speed of the engine (11) to a normal work speed at which the work implement (4, 5) can perform normal work and which controls the speed of the engine (11) to an idling speed serving as a speed lower than the normal work speed when the operating device (16, 17) has been returned from an operating position to a neutral position, wherein:

the main controller (20) performs a control process for bringing the speed of the engine (11) to a specific work speed which is higher than the idling speed but lower than the normal work speed, on detecting execution of the specific work which is performed with an operation amount of the operating device (16, 17) being kept small in the state in which the speed of the engine (11) is kept at the idling speed.

2. An engine speed controller of a working machine according to claim 1, wherein:

the main controller (20) detects the execution of the specific work based on at least one of the operation amount of the operating device (16, 17), an operation speed of the operating device (16, 17), and pump discharge pressure serving as discharge pressure of the main pump (12).

3. An engine speed controller of a working machine according to claim 2, wherein:

the main controller (20) performs a control process for bringing the engine speed to the normal work speed on detecting execution of the normal work when the control process for bringing the engine speed to the specific work speed is being performed due to the detection of the execution of the specific work.

4. An engine speed controller of a working machine according to claim 3, wherein:

the main controller (20) performs a control process to increase the engine speed gradually from the specific work speed up to the normal work speed.

5. An engine speed controller of a working machine according to claim 1, wherein:

the main controller (20) performs a control process for bringing the engine speed to the normal work speed on detecting execution of the normal work when the control process for bringing the engine speed to the specific work speed is being performed due to the detection of the execution of the specific work.

6. An engine speed controller of a working machine according to claim 5, wherein:

the main controller (20) performs a control process to increase the engine speed gradually from the specific work speed up to the normal work speed.

* * * * *